United States Patent [19]

Hogen Esch

[11] Patent Number: 4,742,341

[45] Date of Patent: May 3, 1988

[54] ELECTROMAGNETIC DETECTION SYSTEM, AS WELL AS A RESPONDER FOR SUCH A SYSTEM

[75] Inventor: Johannes H. L. Hogen Esch, Aalten, Netherlands

[73] Assignee: N.V. Nederlandsche Apparatenfabriek Nedap, De Groenlo, Netherlands

[21] Appl. No.: 874,005

[22] Filed: Jun. 13, 1986

[30] Foreign Application Priority Data

Jun. 14, 1985 [NL] Netherlands ..... 8501721

[51] Int. Cl.[4] ..... G08B 13/18

[52] U.S. Cl. ..... 340/572; 343/895

[58] Field of Search ..... 340/572; 343/894, 895

[56] References Cited

U.S. PATENT DOCUMENTS 3,713,133 1/1973 Nathans ..... 340/572

*Primary Examiner*—Glen R. Swann, III

*Attorney, Agent, or Firm*—Fleit, Jacobson, Cohn & Price

[57] ABSTRACT

An electromagnetic detection system comprising transmission unit for producing in at least one first detection zone an electromagnetic interrogation field. The system includes a plurality of responders having attachment element for attachment to articles to be protected, each including a resonant circuit and when present in a detection zone, in response to the interrogation field, producing a signal. The system further includes a first detection adapted to detect a responder and, on detection of a responder, to produce a warning signal. According to the invention, the responders are designed in such a manner that when the attachment elements are removed or when a responder is damaged, at least one frequency determining parameter of the responder is changed in a predetermined manner. At least one second detection zone is provided wherein responders with the at least one changed frequency determining parameter can be detected.

21 Claims, 4 Drawing Sheets

ELECTROMAGNETIC DETECTION SYSTEM, AS WELL AS A RESPONDER FOR SUCH A SYSTEM

BACKGROUND OF THE INVENTION

The present invention relates to an electromagnetic detection system comprising transmission means producing an electromagnetic interrogation field in at least one first detection zone; a plurality of responders having attachment means for attachment to articles to be protected, each including a resonant circuit and, if present in a detection zone, in response to the interrogation field, producing a signal; and first detection means adapted to detect a responder and, on detection of a responder, to produce a warning signal.

Similar detection systems are already known in many embodiments and are mostly used to prevent shop-lifting. The goods to be protected are then each provided with a responder, which is difficult to remove without special tools. When a protected article is purchased, the responder is removed at the cash-desk or deactivated in another manner. At the exit of the shop, the transmission means create interrogation zones which have to be passed for the customer to be able to leave the shop. If an article still carrying a responder is passed through an interrogation zone, this will be detected by the detection means and a warning signal is produced.

In the simplest form of such a system, the transmission means produce an interrogation field having a single frequency identical to the resonate frequency of a single resonant circuit present in each responder. When a responder is present in the interrogation field, the resonant circuit will arrive in the resonant state. The resonant circuit then forms an additional load for the transmission means, which can be detected at the side of the transmission means. In that case we speak of an absorption system. A resonant circuit being in the resonant state also transmits itself a signal, which can be detected by special receiving means. In that case we speak of a transmission system. In a transmission system the responder may alternatively be arranged in such a manner that, in response to an interrogation field, it transmits a signal at one or more predetermined frequencies which differ from the frequency of the interrogation field. This can be effected by means of a frequency divider or multiplier in the responder or by incorporating in the resonant circuit of a responder a non-linear element, such as a diode.

Furthermore, use can be made both in a transmission system and in an absorption system of an interrogation field having a periodically swept frequency. The resonant frequency of the responders then lies within the frequency sweep range of the interrogation field.

A drawback of the prior art detection systems is that these only respond if articles unpaid-for and still provided with an operative responder are taken through an interrogation field. It frequently occurs that it is tried to remove a responder from a protected article already inside the shop, e.g. in the toilets or in the fitting room, by means of tools in an unauthorized manner with the intent to take away this article imperceptibly.

To prevent this, the attachment means, mostly consisting of a hardened steel pin with a broad head inserted through the material of the article to be protected in a ball lock, must be very robust and hence expensive and heavy, so that removal without the use of the special tool is impeded.

It is also tried sometimes to damage the resonant circuit, mostly embedded in a synthetic plastics housing. Such a damaged responder cannot be detected by the prior art systems either. In the past, it had been tried to solve this problem by making the responders more robust. This too, renders the responders more expensive and heavier. The latter again is a drawback when responders are used on vulnerable articles, e.g. clothing of fine materials.

SUMMARY OF THE INVENTION

It is accordingly an object of the present invention to provide a detection system of the above described type by means of which even detached and/or damaged responders can still be detected.

To this end, according to the present invention, a detection system of the above described type is characterized in that the responders are designed in such a manner that when the attachment means are removed or when a responder is damaged, at least one frequency determining parameter of the responder is changed in a predetermined manner and that at least one second spatial detection zone is provided wherein responders with the at least one changed frequency determining parameter can be detected.

BRIEF DESCRIPTION OF THE DRAWINGS

Some embodiments of the present invention will now be described, by way of example, with reference to the accompanying drawings, in which.

DESCRIPTION OF THE PREFERRED EMBODIMENT

Figure 1:
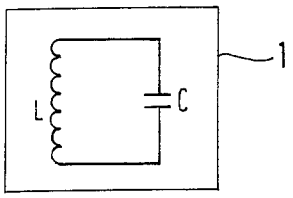
FIG. 1 (Prior Art)
FIGS. 1 and 2 show embodiments of prior art responders for an electromagnetic detection system.
Figure 2:
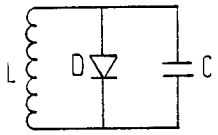
FIG. 2 (Prior Art)

FIGS. 1 and 2 show the electric diagram of two prior art responders. The responder shown in FIG. 1 contains a simple resonant circuit composed of a coil L and a capacitor C. In the responder shown in FIG. 2, the resonant circuit of FIG. 1 is extended by a non-linear element in the form of a diode D, forming, in operation, higher harmonics of the resonate frequency which can be detected by suitably tuned detection means.

FIG. 1 diagrammatically shows the circumference of the responder housing 1 usually consisting of two flat synthetic plastics halves between which the resonant circuit is positioned and which are fixedly attached onto one another. Since coil L has the larger dimensions, it is mostly designed as a wire winding extending on the inside of the housing along its circumference, as shown at 2 in FIG. 3. By cutting into the side of housing 1 with a wire cutter, the coil could be damaged, thereby inactivating the responder.

In the past, it has been suggested to eliminate this problem by embedding in the housing a hardened steel ring extending along the circumference of the housing. However, this means is not always effective and makes responders heavier and relatively expensive.

Figure 3:
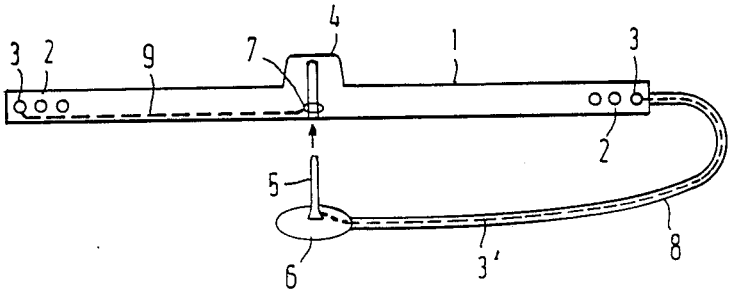
FIG. 3 is a side-elevational view of a responder.

According to one aspect of the present invention, instead of a hardened steel ring, use can be made of a single wire, as shown at 3 in FIG. 3. Wire 3 may be a connecting wire between a first and an additional second coil or capacitor of the resonant circuit, or conversely, a wire bypassing an additional coil or capacitor. In the first case, when the wire is cut, the second coil or capacitor is disabled so that the resonate frequency of the responder is changed in a predetermined manner. In the second case, conversely, a second coil or capacitor is effectively connected to the resonant circuit, thereby also changing the resonate frequency.

When a diode is connected to the resonant circuit, wire 3 can also be used as a connection between the resonant circuit and the diode or just as a bypass of the diode. In these cases, too, the frequency spectrum of the responder changes in a predetermined manner.

Some embodiments of the electric diagrams of responders thus designed are shown in FIGS. 4–8.

Figure 4:
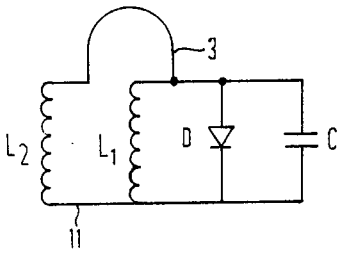
FIGS. 4(*a*), (*b*), (*c*) show a resonant circuit including two parallel-connected coils.
Figure 4:
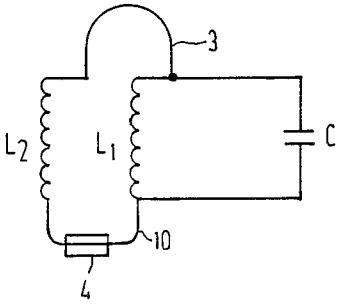
Figure 4:
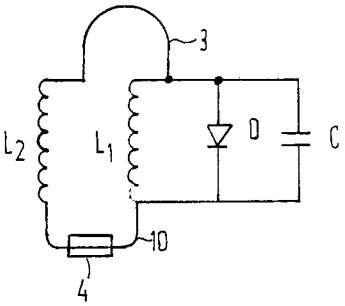

The responder shown in FIGS. 4(*a*) (*b*) and (*c*) has a resonant circuit normally including two parallel-connected coils L1 and L2 and a capacitor C. Furthermore, there may or may not be provided a non-linear element, such as the diode D as indicated in broken lines to obtain non-linear properties. Wire 3 forms one of the connections between coil L2 and coil L1. The resonate frequency is determined by L1, L2 and C. When wire 3 is cut in an attempt to inactivate the responder, or is interrupted in another manner, coil L2 is no longer connected to coil L1 and capacitor C. The resonate frequency of the responder is then determined by L1 and C.

Figure 11:
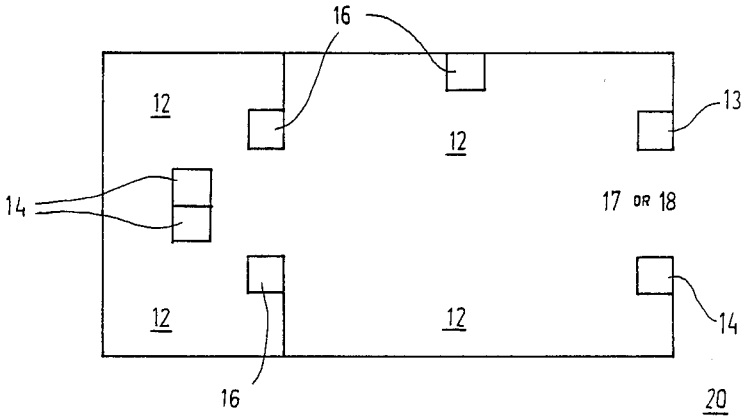
FIG. 11 shows a suitable shop according to a preferred embodiment of the present invention.

As shown in FIG. 11 by, creating second detection zones 12 in suitable places in a shop 20, e.g. in the toilets, in fitting-rooms, near clothes stands, by using transmission means 14 forming an interrogation field having a frequency tuned to the circuit formed by coil L1 and capacitor C, and installing associated detection means 13 or 16, it can be detected that a responder has been damaged.

The detection means 16 associated with a second detection zone are preferably so arranged that normal responders are not detected. However, it is possible to combine a first detection zone 17 with a second detection zone 12 and form a detection zone 18, as will be described hereinafter.

Figure 5:
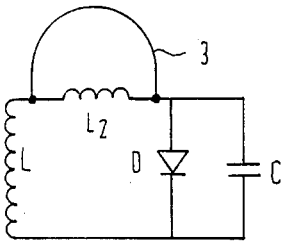
FIGS. 5(*a*), (*b*), (*c*) show a resonant circuit including two serial-connected coils.
Figure 5:
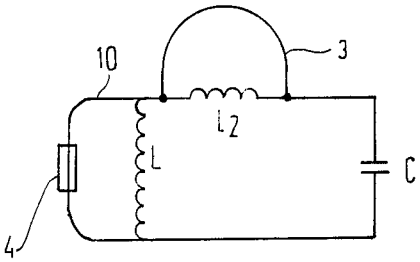
Figure 5:
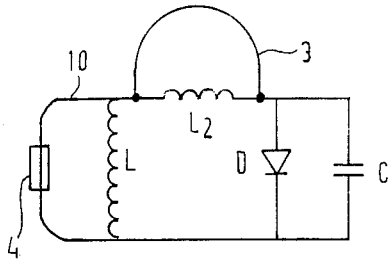

In the responder shown in FIGS. 5(*a*), (*b*) and (*c*), the resonant circuit comprises a coil L1 and a capacitor C. Connected in series with coil L1 is an additional coil L2, normally inactivated by short circuiting wire 3. When the wire is cut, coil L2 is also activated, thereby changing the resonate frequency of the circuit.

Figure 6:
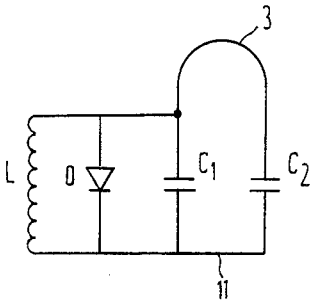
FIGS. 6(*a*), (*b*), (*c*) and 7(*a*), (*b*), (*c*) show an additional capacitor connected according to an embodiment of the present invention.
Figure 6:
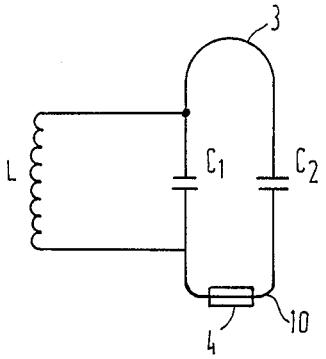
Figure 6:
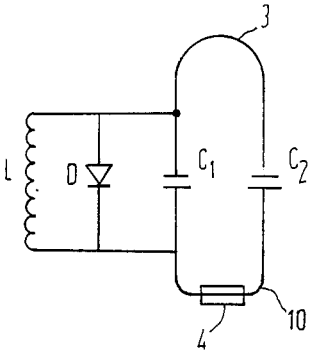

FIGS. 6(*a*), (*b*), (*c*) and 7(*a*), (*b*), (*c*) are similar to FIGS. 3 and 4(*a*), (*b*) and (*c*), except that wire 3 now connects an additional capacitor C2 to the rest of the circuit or bypasses the additional capacitor C2.

Figure 8:
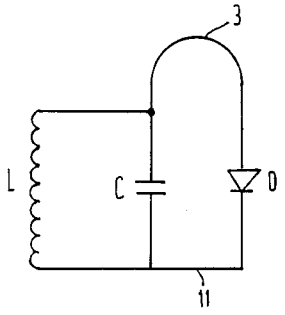
FIGS. 8 and 8(*a*) show a diode connected to an embodiment of the present invention.
Figure 8A:
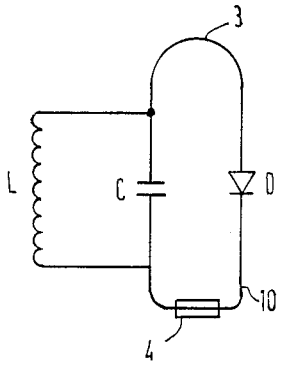

In the embodiment shown in FIGS. 8(*a*) and (*b*), wire 3 forms a connection between a resonant circuit LC and a diode D. Wire 3 could also bypass the diode.

It is observed that wire 3 should extend along the entire circumference of the housing of the responder in order to obtain proper protection. This means that wire 3 has inductive properties and e.g. in the case of FIG. 4 could alternatively form the additional coil L2. To this end, wire 3 may be installed in a plurality of windings. If the inductive properties of wire 3 are undesirable, the wire may, for example, be designed as a shielded wire or be disposed in such a manner that always two wire portions with opposite directions of current are next to one another.

FIG. 3 shows a lock 4 disposed on the responder housing, said lock being designed in one of the manners known in the art and adapted to clamp a thin pin, e.g. a steel nail 5. Pin 5 has a broad head 6 and the article to be protected is clamped between head 6 and responder housing 1 when the pin is inserted in the lock. The responder housing has a bore 7 allowing the pin to pass. In order to prevent the pin from being lost, head 6 is generally connected to the responder housing by means of a flexible strip 8.

In order to detect any unauthorized removal or cutting of pin 5, wire 3 can comprise a section 3' extending from the edge of responder housing 1 through strip 8 to the head of pin 5, as shown in broken lines. The circuit formed by wire 3 with section 3' is closed within the responder housing by pin 5 and a contact coacting therewith and connected to wire 3, or through pin 5 and a metal part of the lock connected again to wire 3, as shown at 9.

Figure 7:
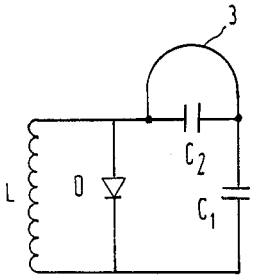
Figure 7:
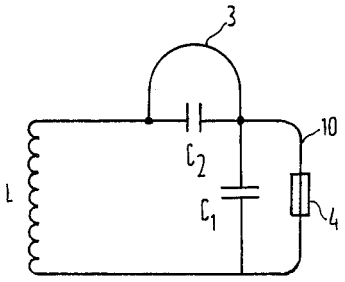
Figure 7:
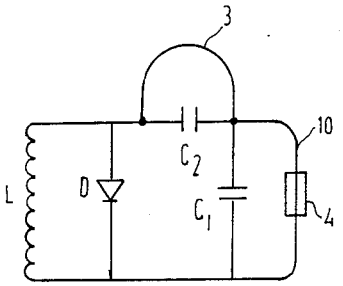

Instead of a section of wire 3, a separate electric connection 10 comprising the lock may be used, as diagrammatically shown in FIGS. 4–8. Breaking the connection 10 by cutting the flexible strip 8 or pin 5, or by removing pin 5 has a similar effect as breaking the connection 3. Naturally, the wire portions 11 bypassed by connection 10 is omitted in some of the embodiments of FIGS. 4, 6 and 8. In the embodiment of FIGS. 4, 6 and 8, the effect of breaking connection 3 is exactly identical to the effect of breaking connection 10. In FIGS. 5, 7, these effects can also be made the same by making L1 and L2, and C1 and C2 the same.

The flexible strip 8 can now take the form of a simple plasticized wire, while lock 4 and pin 5 can be very light, and, in actual fact, only need to serve as a plug-and-socket combination, which combination need only be protected against the plug becoming accidentally detached. Pin 5 need no longer be a hardened steel pin either. It is also possible for the pin to be designed as a coaxial plug, having at the end extending into the responder housing two insulated contacts which, when the pin is inserted, are each in contact with an end of wire 3 or 10, which may now be situated fully within the housing. The insulated contacts are furthermore interconnected in or adjacent the head of the pin.

Figure 9:
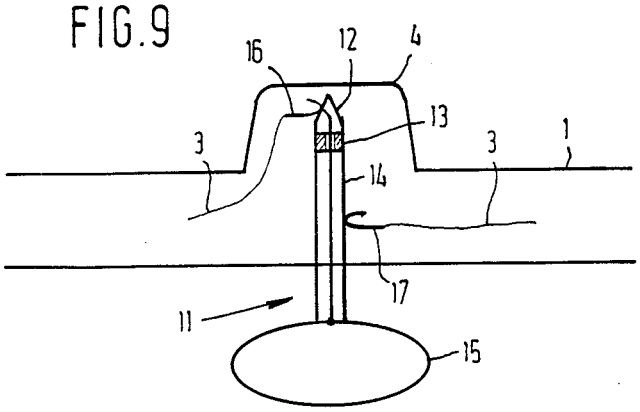
FIGS. 9 and 10 show two embodiments of attachment means for a responder according to the present invention, by way of example.

One embodiment is shown diagrammatically in FIG. 9. The pin designed as a coaxial plug is shown at 11 and comprises a metal end portion 12 electrically isolated from the rest of pin 11 by an insulating ring 13. The shank 14 of the pin is also made of metal and is hollow. Through the shaft extends a wire or a thinner pin which is connected to the end portion 12 and to the head 15.

The responder housing contains two contacts 16 and 17 which, when the pin is inserted, make contact with the end portion, and the shaft, respectively and which each are connected to an end of wire 3 (or wire 10). Thus the circuit of wire 3 is closed via the head 15 of the pin and is broken when the pin is removed or cut.

A similar effect can be achieved when use is made of two adjacent pins, which each coact with a contact in the responder housing and the ends of which projecting from the responder housing are electrically interconnected.

Another possibility is for the head of the pin to be designed as a magnet or for it to be provided with a magnet and to provide a reed switch for the responder housing in the circuit of wire 3 or wire 10.

Figure 10:
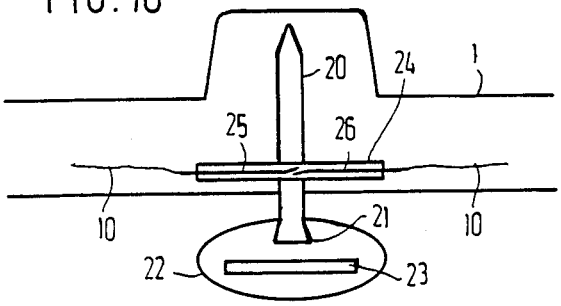

This embodiment is shown diagrammatically in FIG. 10. The pin 20 shown has a small head 21 embedded in a larger synthetic plastics head 22 including also a magnet 23. Provided opposite the magnet in the responder housing 1 is a reed switch 24 whose contacts 25,26 in the presence of the magnet, are kept closed or open, and which, on removal of the magnet, by tearing loose or cutting the pin are opened or closed. Thus by removing or cutting the pin the circuit of wire 10 (or wire 3), is closed or opened.

As shown in FIG. 11 and with regard to the second detection zones 12 wherein a responder in which, in the above described manner, a change in state has been produced as a result of damage, to, or removal of, the pin, can be detected, it is observed that these can partly coincide with the first detection zones 17. For instance, a detection zone 18 can be formed advantageously near an exit of a shop, in which zone both normal responders and damaged responders can be detected. When responders of the type shown in FIGS. 5–7 are employed, the interrogation field should comprise both the resonate frequency of a normal responder and that of a damaged responder. The required transmission means 14 can be combined to this effect. Besides, the associated detection means 13 should be adapted to detect both damaged and normal responders.

In a responder of the type shown in FIG. 8, the interrogation field may remain unchanged and only the detection means need be extended or adjusted for them to be able to detect damaged responders, too.

It is observed that after the foregoing, various modifications will readily occur to those skilled in the art without departing from the scope of the present invention.

What I claim:

1. An electromagnetic detection system comprising transmission means producing in at least one first detection zone an electromagnetic interrogation field; a plurality of responders having attachment means for attachment to articles to be protected, each including a resonant circuit and an electric circuit and which, if present in said first detection zone, in response to the interrogation field, produce a signal; and detection means associated with said first detection zone adapted to detect the responder and, on detection of the responder to produce a warning signal, characterized in that the responders are designed in such a manner that when the attachment means are removed or when the responder is damaged, at least one frequency determining parameter of the responder is changed in a predetermined manner and that at least one second detection zone is provided wherein responders with the at least one changed frequency determining parameter can be detected; each of said plurality of responders having at least one connection wire extending along the edge of each responder, said wire forming an electric connection between a frequency determining component of the electric circuit of the responder and other frequency determining components of the resonant circuit; and said resonant circuit includes at least two parallel-connected coils and that the connection wire forms a connection between the two coils and that the connection wire also forms one of the coils.

2. A electromagnetic detection system according to claim 1, characterized in that at least one of the second detection zones coincides at least partly with at least one of the first detection zones.

3. An electromagnetic detection system according to claim 2, characterized in that the detection means associated with the first detection zones are adapted to also detect said responder when a frequency determining parameter has been changed.

4. An electromagnetic detection system comprising transmission means producing in at least one first detection zone an electromagnetic interrogation field; a plurality of responders having attachment means for attachment to articles to be protected, each including a resonant circuit and an electric circuit and which, if present in said first detection zone, in response to the interrogation field, produce a signal; and detection means associated with said first detection zone adapted to detect said responder and, on detection of said responder to produce a warning signal, characterized in that the responders are designed in such a manner that when the attachment means are removed or when the responder is damaged, at least one frequency determining parameter of the responder is changed in a predetermined manner and that at least one second detection zone is provided wherein responders with the at least one changed frequency determining parameter can be detected; each of said plurality of responders having at least one connection circuit forming an electric connection between a frequency determining component of the electric circuit of the responder and other frequency determining components of the responder, with said at least one connection circuit being closed by at least a part of the attachment means, and a lock adapted to receive an end of a conductive pin, the free end of the pin being connected to the responder by means of a flexible strip, characterized in that the connection circuit comprises a conductor extending through the flexible strip, which conductor is connected to the free end of the conductive pin, the connection circuit further comprising at least one contact member disposed in the lock and being adapted to coact with the pin.

5. An electromagnetic detection system according to claim 4, characterized in that said at least one connection circuit comprises the at least one connection wire.

6. An electromagnetic detection system according to claim 4, characterized in that at least one of the second detection zones coincides at least partly with at least one of the first detection zones.

7. An electromagnetic detection system according to claim 6, characterized in that the detection means associated with the first detection zones are adapted to also detect said responder at a frequency determining parameter of which has been changed.

8. An electromagnetic detection system comprising transmission means producing in at least one first detection zone an electromagnetic interrogation field; a plurality of responders having attachment means for attachment to articles to be protected, each including a resonant circuit and an electric circuit and which, if present in said first detection zone, in response to the interrogation field, produce a signal; and detection means associated with said first detection zone adapted to detect said responder and, on detection of said responder to produce a warning signal, characterized in that the responders are designed in such a manner that when the attachment means are removed or when the responder is damaged, at least one frequency determining parameter of the responder is changed in a predetermined manner and that at least one second detection zone is provided wherein responders with the at least one changed frequency determining parameter can be detected; each of said plurality of responders having at least one connection circuit forming an electric connection between a frequency determining component of the electric circuit of the responder and other frequency determining components of the responder, with said at least one connection circuit being closed by at least a part of the attachment means, and a lock adapted to receive the end of a conductive pin, characterized in that the pin is designed as a plug member having two isolated portions, each adapted to coact with an associated contact member in the lock and to form an electrical connection adjacent the free end of the pin.

9. An electromagnetic detection system according to claim 8, characterized in that the pin is designed as a coaxial plug.

10. An electromagnetic detection system according to claim 8, characterized in that at least one of the second detection zones coincides at least partly with at least one of the first detection zones.

11. An electromagnetic detection system according to claim 10, characterized in that the first detection means associated with the first coinciding detection zones are adapted to also detect said responder at a frequency determining parameter of which has been changed.

12. An electromagnetic detection system comprising transmission means producing in at least one first detection zone an electromagnetic interrogation field; a plurality of responders having attachment means for attachment to articles to be protected, each including a resonant circuit and an electric circuit and which, if present in said first detection zone, in response to the interrogation field, produce a signal; and detection means associated with said first detection zone adapted to detect said responder and, on detection of said responder to produce a warning signal, characterized in that the responders are designed in such a manner that when the attachment means are removed or when the responder is damaged, at least one frequency determining parameter of the responder is changed in a predetermined manner and that at least one second detection zone is provided wherein responders with the at least one changed frequency determining parameter can be detected; each said plurality of responders having at least one connection wire extending along the edge of the responder, said wire forming an electric connection between a frequency determining component of the electric circuit of the responder and other frequency determining components of the resonant circuit; and said attachment means having a magnet and that the connection wire includes a reed switch disposed with the responder, the position of said switch being adjacent to the magnet when the attachment means are in the closed position.

13. An electromagnetic detection system according to claim 12, characterized in that the resonant circuit comprises at least two parallel-connected coils and that the connection wire forms a connection between the two coils.

14. An electromagnetic detection system according to claim 13, characterized in that the connection wire also forms one of the coils.

15. An electromagnetic detection system according to claim 12, characterized in that the resonant circuit comprises at least two serially connected coils and that the connection wire bypasses one of the coils.

16. An electromagnetic detection system according to claim 12, characterized in that the resonant circuit comprises at least two parallel capacitors and that the connection wire forms a connection between the two capacitors.

17. An electromagnetic detection system according to claim 12, characterized in that the resonant circuit comprises at least two series-connected capacitors and that the connection wire bypasses one of the capacitors.

18. An electromagnetic detection system according to claim 12, characterized in that the resonant circuit comprises a non-linear element and that the connection wire connects the non-linear element to the rest of the circuit.

19. An electromagnetic detection system according to claim 12, characterized in that at least one of the second detection zones coincides at least partly with at least one of the first detection zones.

20. An electromagnetic detection system according to claim 19, characterized in that the first detection means associated with the first coinciding detection zones are adapted to also detect said responder at a frequency determining parameter of which has been changed.

21. An electromagnetic detection system according to claim 16, characterized in that the responder circuit comprises a non-linear element and that the connection wire bypasses the non-linear element.

* * * * *